US006456815B1

(12) United States Patent
Odell et al.

(10) Patent No.: US 6,456,815 B1
(45) Date of Patent: Sep. 24, 2002

(54) DEVELOPER APPARATUS INCLUDING A COATED DEVELOPER ROLLER

(75) Inventors: Peter G. Odell, Mississauga (CA); Thomas Thomson, Fairport, NY (US); Jas Paul S. Dhillon, Pittsford, NY (US); Yvonne J. M. Groot, Horst (NL); Michael F. Zona, Holley, NY (US); Richard D. Hunt, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/724,833

(22) Filed: Nov. 28, 2000

(51) Int. Cl.[7] ..... G03G 15/08

(52) U.S. Cl. ..... 399/286; 428/195; 492/53

(58) Field of Search ..... 399/265, 267, 399/272, 275, 276, 279, 281, 282, 286; 428/36.9, 195; 430/105, 106.6, 120, 122; 492/56, 59, 8, 16, 53; 118/16; 29/895, 895.32

(56) References Cited

U.S. PATENT DOCUMENTS 5,025,004 A 6/1991 Wu et al. ..... 514/165
5,071,904 A 12/1991 Martin et al. ..... 524/458
5,153,377 A * 10/1992 Kuwashima et al. .... 399/276 X
5,245,392 A * 9/1993 Behe et al. ..... 399/286
5,587,224 A 12/1996 Hsieh et al. ..... 428/195
5,897,477 A * 4/1999 Nakatogawa et al. ..... 492/56
5,972,809 A 10/1999 Faler et al. ..... 442/103
6,122,473 A * 9/2000 Goseki et al. ..... 399/286
6,253,053 B1 * 6/2001 Litman et al. ..... 399/286

FOREIGN PATENT DOCUMENTS

WO WO 99/42529 8/1999
WO WO 00/35600 6/2000

* cited by examiner

*Primary Examiner*—Hoan Tran
(74) *Attorney, Agent, or Firm*—Oliff & Berridge, PLC; Eugene O. Palazzo

(57) ABSTRACT

The present invention relates to improved methods of coating donor members with waterbome coatings, wherein a resin, a pigment, and water are combined in proportions effective to provide a donor member precursor composition; the donor member precursor composition is subjected to high pressure communition to provide a donor member conductive coating composition; and the donor member coating composition is coated onto a substrate. The present method advantageously provides a donor member coating which is substantially free of air pockets or defects. In preferred embodiments the resin is a phenolic resin, preferably a waterborne phenolic resin, such as a phenol-formaldehyde resole, and in other preferred embodiments the pigment is selected from the group consisting of carbon black, graphite, magnetite, nigrosine, and combinations thereof.

32 Claims, 3 Drawing Sheets

DEVELOPER APPARATUS INCLUDING A COATED DEVELOPER ROLLER

BACKGROUND OF THE INVENTION

The present invention relates to polymeric coatings for developer, or "donor" members used in electrophotographic image development systems. In xerography, or electrophotographic printing, a charge retentive surface called a photoreceptor is electrostatically charged, then exposed to a light pattern of an original image to selectively discharge the surface in accordance with the image, i.e., "imagewise". The resulting pattern of charged and discharged areas on the photoreceptor form an electrostatic charge pattern ("latent image") conforming to the original. The latent image is developed by contacting it with a finely divided electrostatically attractable powder called "toner." Toner is held on the image areas by the electrostatic charge on the photoreceptor surface. Thus, a toner image is produced in conformity with a light image of the original being reproduced. The toner image may then be transferred to a substrate or support member such as paper, and the image is affixed to the paper to form a the desired permanent image on the substrate. After development, excess toner left on the charge retentive surface is cleaned from the surface.

The step of conveying toner to the latent image on the photoreceptor is known as "development." The object of effective development of a latent image on the photoreceptor is to convey toner particles to the latent image at a controlled rate so that the toner particles effectively adhere electrostatically to the appropriately-charged areas on the latent image.

A commonly used development technique involves a single-component developer material. In a typical single-component development system, each toner particle has both magnetic properties, to allow the particles to be magnetically conveyed to the photoreceptor, and an electrostatic charge, to enable the particles to adhere to the photoreceptor. In such a system, the developer, or "donor" member is a cylindrical sleeve ("donor roll") which rotates about a stationary magnet assembly. The magnetized toner particles adhere to the rotating sleeve by the force of the stationary magnets within the sleeve. As the sleeve rotates around the magnets, particles adhering to the sleeve are exposed to an alternating series of magnetic polarities. The developer roll has a conductive coating which facilitates the adherence of toner to its surface. The coating typically includes a conductive pigment and a binder composition.

The option of eliminating organic solvents from coating procedures has many benefits. It eliminates the need to build a coating plant to the stringent and costly Class I Division I or II ("explosion proof") specification for the use of flammable liquids. Since engineering controls, such as classified rooms and fume hoods, can only reduce the risk, there is a health and safety benefit to the plant operators in replacing organic solvents with water. The need to reclaim, destroy or account for the volatile organic compound (VOC) emissions is removed, which also provides cost savings. Also, by reducing or even eliminating VOC emissions, the plant design can be consistent in many locations, despite any variations in local regulations.

SUMMARY OF THE INVENTION

The present invention relates to improved donor members having coatings thereupon which are made via an environmentally friendly process and without the drawbacks of prior attempts at water-based donor member coatings. Before the present invention, grinding of pigment into water-based phenolic resins, unlike organic-based coatings, was very likely to result in dispersion thickening and foaming. In extreme cases this foam is very stiff (meringue-like) and unsuitable for coating. Even small amounts of air entrainment can result in coating defects.

The present invention relates to improved methods of coating donor members with waterbome coatings, wherein a resin, a pigment, and water are combined in proportions effective to provide a donor member precursor composition; the donor member precursor composition is subjected to high pressure communition to provide a donor member conductive coating composition; and the donor member coating composition is coated onto a substrate. The present method advantageously provides a donor member coating which is substantially free of air pockets or other defects. The resin may be a phenolic resin, preferably a waterbome phenolic resin, such as Durez 33304 (Oxychem Chemical Corporation) or BB 317 (Neste Chemical), and in other preferred embodiments the pigment may be, e.g., carbon black, graphite, magnetite, nigrosine, or a combination of these pigments.

The high pressure communition step may be carried out using a high pressure communition device such as a piston homogenizer. One or two stage homogenizers may be used.

In another embodiment, the invention defines an image forming apparatus which has a charge-retentive surface to receive an electrostatic latent image, and a donor member for applying a developer material to develop the electrostatic latent image to form a developed image. The donor member is coated with a waterborne donor member coating composition prepared as described herein.

In yet another embodiment, the invention relates to coated donor rolls having a core with a coating composition thereupon, the donor member coating composition prepared by combining a resin, a pigment, and water in proportions effective to provide a donor member coating precursor composition; and subjecting the donor member coating precursor composition to high pressure communition.

Also included in this invention is an image forming apparatus including a charge-retentive surface for receiving an electrostatic latent image, and a donor roll having a core and a donor member coating prepared by a combining a resin, a conductive pigment, and water in proportions effective to provide a donor member conductive coating precursor composition, and subjecting the donor member conductive coating precursor composition to high pressure communition; and a transfuse component for transferring and fusing the developed image from the charge retentive surface to a copy substrate.

In another embodiment the invention encompasses an image forming apparatus having a charge-retentive surface for receiving an electrostatic latent image; and a donor roll to apply a developer material to the charge-retentive surface to develop the electrostatic latent image and form a developed image on the charge retentive surface. The donor roll is coated with a waterborne donor member coating composition of the invention. The image forming apparatus further includes a transfer component to transfer the developed image from the charge retentive surface to a copy substrate; and a fixing component to fuse the transferred developed image to the copy substrate.

In an even further embodiment, the invention includes an image forming apparatus for forming images on a recording medium, which has a charge-retentive surface for receiving an electrostatic latent image; and a donor roll with a core and a coating of the present invention for applying a developer material to the charge-retentive surface to develop the electrostatic latent image to form a developed image on the charge retentive surface. The apparatus also includes a transfuse component for transferring the developed image from the charge retentive surface to a copy substrate, and for fusing the developed image to the copy substrate.

DETAILED DESCRIPTION OF THE INVENTION

Figure 1:
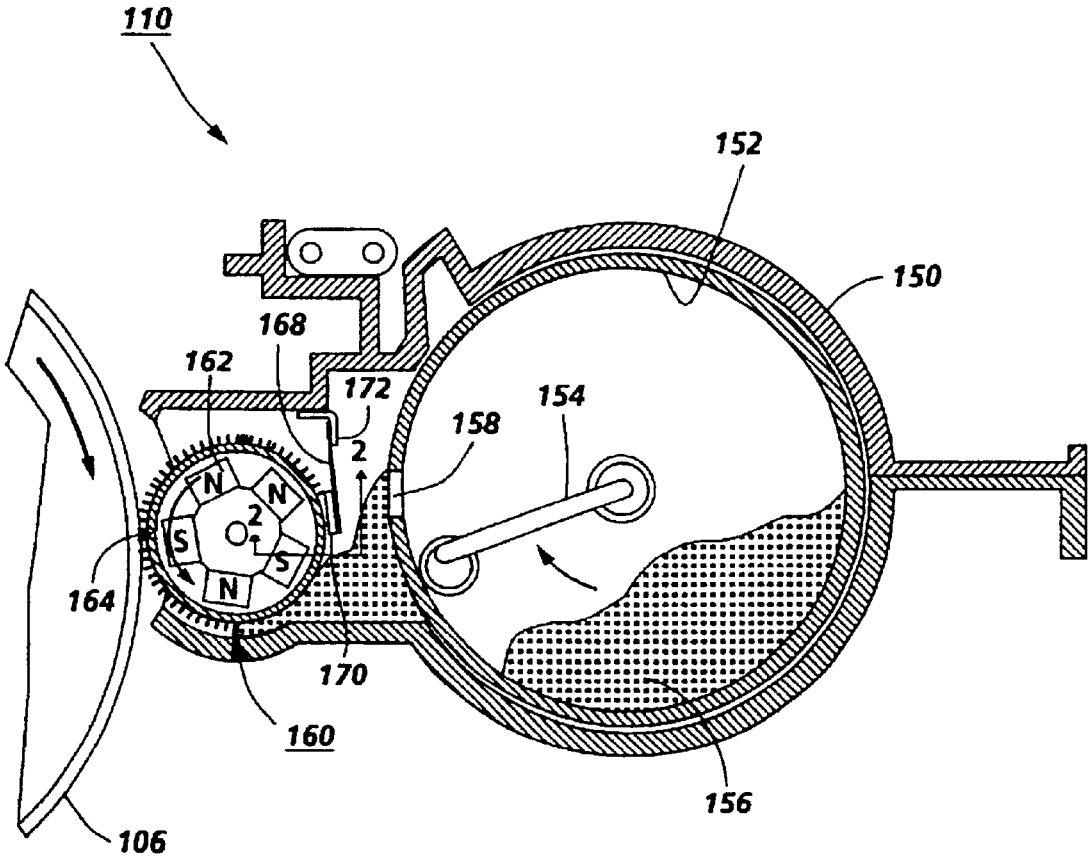
FIG. 1 is a sectional, elevational view showing a detail of the development apparatus of an electrophotographic printer.
Figure 2:
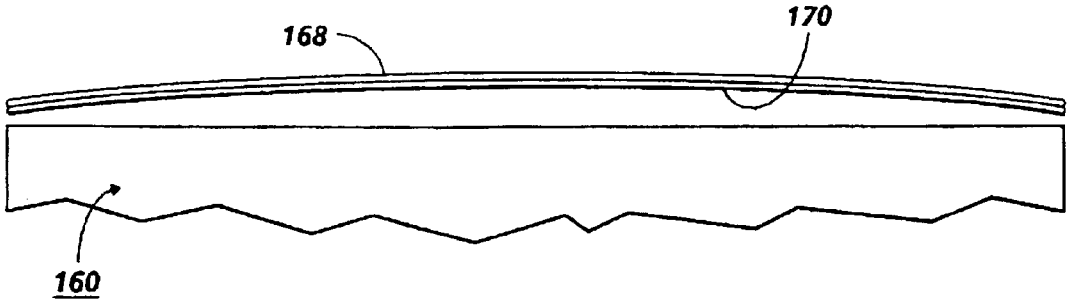
FIG. 2 is a sectional view through line 2—2 in FIG. 1, showing the configuration of a metering blade relative to a donor roll when the metering blade is separated from the donor roll and there is no toner in the system.

The present invention provides for water-based coating materials which allow for preparing donor members, advantageously avoiding thickening and foaming, i.e., undesirable air entrainment, which almost inevitably results in coating defects, the coatings obtained are suitable for high quality images with solid area development greater than 1.3 and the absence of ghosting.

The present invention encompasses improved methods of coating donor members with waterbome coatings. A resin, a pigment, and water are combined in proportions effective to provide a donor member coating precursor composition, and the donor member coating precursor composition is subjected to high pressure communition. A conductive donor member coating results which can then be coated onto a substrate, i.e., a donor roll core. The present method advantageously provides a donor member coating which is substantially free of air pockets or other defects. "Waterbome coatings" in accordance with the present invention have water as a substantial part of the carrier portion of the coating composition, e.g., greater than 75%, 80%, 85%, 90%, or 95% of the carrier. While other solvents may be included it is more desirable that the composition be mostly water to preserve the benefits of little or no VOC emission. "Donor member coating precursor composition" includes compositions of the invention which are prepared prior to high pressure communition, i.e., compositions including resin, a conductive pigment, and water in effective proportions for donor members. The precursor composition ingredients may be mixed together, or, more desirably, simple homogenization, e.g., with a rotor stator mixer.

In preferred embodiments the resin is a phenolic resin, preferably a waterborne phenolic resin, such as Durez 33304 (Oxychem Chemical Corporation) or BB 317 (Neste Chemical). "Phenolic resin" includes art-recognized compositions falling under this classification, e.g., phenol-formaldehyde resoles. Resoles are phenolic resins made by combining an excess of formaldehyde with phenolic compounds and are typically alkaline, imparting the potential for such resins to be waterborne. Typical novolac resins, by contrast, does not have an excess of formaldehyde and is acidic, making it difficult to be carried in a water based vehicle. The solids loading of the present coating dispersion is from about 25% to 30% (% by weight) in water. The solids component preferably contains about 50% to 75% waterborne phenolic resin, preferably about 55%–65%; about 20% to 40% graphite particles, preferably about 26%–30%; and about 5% to 20% of conductive carbon black, preferably about 9%–13%.

The pigment may be, e.g., carbon black, graphite, magnetite, nigrosine, or combinations of pigments. Preferably both carbon black and graphite are used. The solids loading of the coating dispersion is from about 25% to 30% in water, with the solids component containing about 20% to 40% of graphite particles, preferably 26–30 wt%; and about 5% to 20% conductive carbon black such as Conductex 975 (Columbia Chemical Corp.), preferably 9%–13%. Exemplary graphite particles include Rollit DS-1010 (Timcal), CSPE (Nippon Graphite), and M890 (Asbury Graphite)

The high pressure communition may be carried out using a device such as a piston homogenizer, e.g., one or two stage homogenizers. High pressure communition devices such as piston homogenizers or a Microfluidizer® share a similar mechanism of particle breakdown. Both drive a fluid at high pressure through a small orifice, the homogenizer valve in the former, and the interaction chamber in the latter. The resulting shear and cavitation breaks down agglomerates and disperses particles in the fluid. With a piston homogenizer, a second stage valve can also be employed to reduce the fluid viscosity that often increases after the first stage disperses the colloidal pigments. While both types of devices are applicable, a piston homogenizer is more readily operated and serviced. These devices also offer much faster throughput than media mills.

Various process options are available with a piston homogenizer; the principle parameters are pressure, number of passes through the homogenizer valve, and the valve configuration itself. The most important variable is pressure, good results may be obtained with a pressure of about 1000 to 1500 bar, preferably 1100 to 1200 bar. Near equivalent results may be achieved by two passes through the homogenizer at 800 bar, but this appears to be less efficient.

The coating compositions of the invention may be used to provide improved toner donor member coatings as well as overcoatings for electrophotographic development subsystem donor members, and may also be used to protect electrodes on a donor member from wear, and/or to prevent electrical shorting with a developer material's conductive carrier beads. Specific examples of coatings of the invention, and their application to developer members, are detailed below in the Examples.

One aspect of the present invention includes apparatus for applying toner particles on a charge-retentive surface to develop an electrostatic latent image on the charge-retentive surface. A donor member such as a roll and rotatable in a process direction, conveys toner particles on a surface thereof from a supply of toner particles to a development zone close to the charge-retentive surface.

Another embodiment of the present invention includes an electrostatographic printing apparatus featuring a charge-retentive surface which is adapted to retain an electrostatic latent image, and a supply of toner particles. A donor member such as a roll rotates and conveys toner particles on its surface from the toner supply to a development zone close to the charge-retentive surface.

Since the art of electrophotographic printing is well known, the various processing stations employed in a printing machine will be shown schematically and their operation described briefly.

Figure 3:
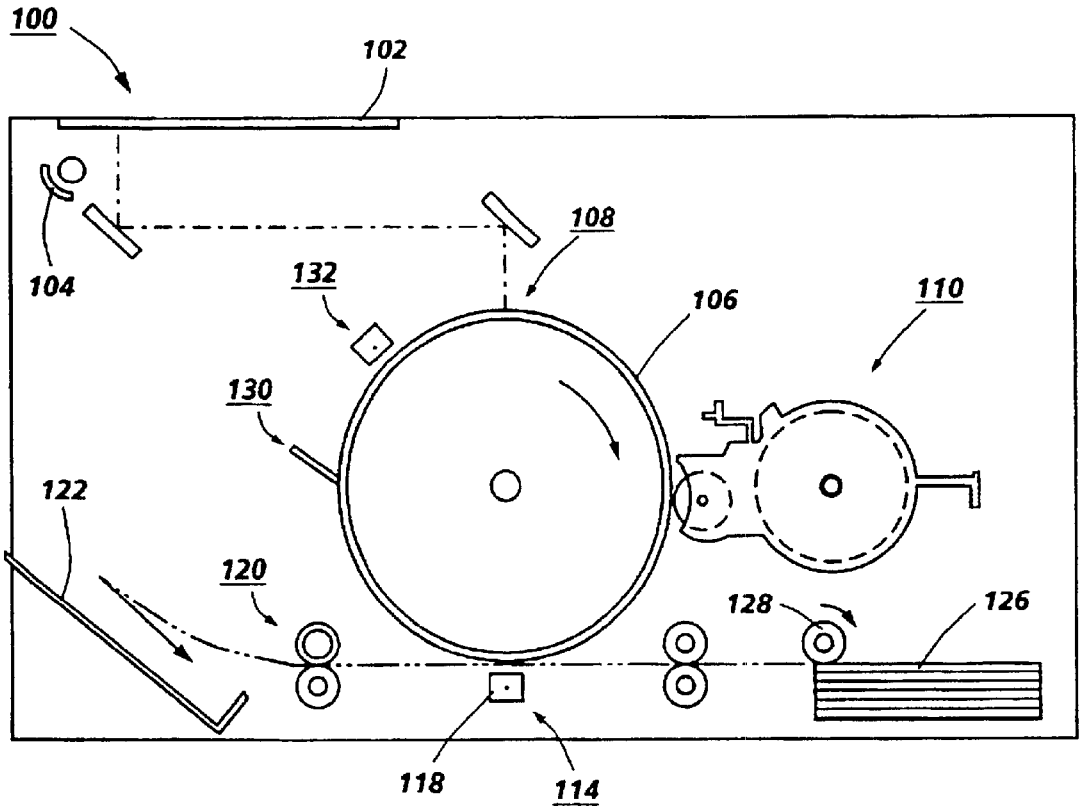
FIG. 3 is an elevational view showing the basic elements of a typical electrophotographic printer.

FIG. 3 shows the basic elements of a typical electrophotographic printer 100. A document to be reproduced is placed on a platen 102 where it is illuminated by light source 104. The exposed document is imaged onto the photoreceptor 106 by a system of mirrors as shown. The optical image selectively discharges the surface of photoreceptor 106 in an image configuration, resulting in an electrostatic latent image of the original document recorded on the drum 106 at imaging station 108. The photoreceptor drum 106 rotates so that the latent image is moved towards development unit 110, where the electrostatic latent image is developed, by the application of toner particles.

The main body of development unit 110 is encased in a developer housing 150, which accommodates a cylindrical toner cartridge 152. Toner cartridge 152 typically includes a rotatable agitator 154, which engages a rotating driver to keep the toner well-mixed and aerated so that toner 156 will flow easily and not coagulate. Opening 158 allows for removal of toner. Developer roll 160 comprises a stationary magnet assembly 162 enclosed within a rotating cylindrical sleeve 164. Stationary magnet assembly 162 includes a plurality of permanent magnets, with each magnet extending substantially the length of the developer roll 160, and arranged as known in the art such that the toner particles adhere to the surface of outer sleeve 164. The rotation of outer sleeve 164 causes the toner particles to move around the developer roll 160 to a development zone adjacent the surface of the photoreceptor 106.

Although developer roll 160 is shown as having a rigid sleeve 164, the "donor member" can be any member for conveying the toner particles to the development zone, such as a flexible belt. The ends of the developer roll 160 are intended to be ends of the cylinder formed by a rigid developer roll 160; if the donor member is in the form of a flexible belt, the ends are intended to be the lateral edges of the belt. Metering blade 168 smoothes out the layer of toner particles on sleeve 164 so that the layer will be uniform when it is brought into contact with photoreceptor 106, and also to charge the toner. Metering blade 168 features a compressible pad 170 is anchored in position by a blade holder 172.

The developed image is transferred at the transfer station 114 from photoreceptor 106 to a sheet of paper delivered from a paper supply system into contact with the drum 106 in synchronous relation to the image thereon. A transfer corotron 118 provides an electric field to assist in the transfer of the toner particles to the copy sheet. Individual sheets are introduced into the system from a stack of supply paper 126 by a friction feeder 128. A separated sheet is fed, in the embodiment shown, by further sets of nip roll pairs through a path indicated by the broken line. The image is subsequently fused onto the paper at fusing station 120 and the finished copy is deposited in hopper 122. Residual toner is removed from the photoreceptor drum 106 by cleaning blade 130, and then the surface is recharged by charging corotron 132, for imagewise discharging of the photoreceptor in a subsequent cycle.

When a thin layer of uniformly-charged particles is obtained, the developer roll advances the toner particles to a development zone adjacent the surface of the photoreceptor. In the development zone, the toner particles adhering magnetically to the developer roll are attracted electrostatically to the latent image recorded on the photoreceptor. AC and DC biases may be applied to the donor roll to enhance and control this process.

The invention is further illustrated by the following examples, which should not be construed as further limiting the subject invention.

EXAMPLE 1

In a 1L polyethylene container 27.9g of graphite (Nippon graphite CSPE), 14.2g carbon black (Columbia, Conductex 975), 106g Durez 33304 phenolic resin (Occidental Chemical Corp.) and 140 ml DI water were combined to make a donor member precursor composition. The precursor composition was homogenized with a 2" rotor stator mixer at about 12000 rpm for one minute, stopped for five minutes, processed for two minutes, stopped for five, and then processed for another two minutes, while maintaining the vessel in an ice bath.

EXAMPLE 2

The mixture of Example 1 was passed through a single stage piston homogenizer (Niro Soavi Panda) at a pressure of greater than 800 bar. The coating mixture was then placed in a Tsukiagi cup coater and coated onto an 18 mm diameter aluminum sleeve at a withdrawal rate of about 380 mm/min. The coated rod was allowed to air dry for about 40 minutes and then placed in an oven at 80° C. for 30 min. to speed the removal of the water. The temperature was then slowly raised to about 140° C. for 40 minutes and then raised to 150° C. for another 30 minutes to cure the resin. The coating of the sleeve was complete and fairly uniform with some number of surface defects such as pinholes. Pinholes arise from some air entrainment in the coating dispersion and they will cause print defects; however these can be eliminated by one or a combination of two approaches: use of a recirculating reservoir for the diptank (rather than the static cup coating technique), or the optimization of the resin, e.g., substitution with other resins which are less prone to producing this this type of defect, e.g., Neste BB317 resin.

EXAMPLE 3

To illustrate the differences in the coating compositions of the present invention in light of prior art methods, e.g., to illustrate that media mills entrain too much air in these formulations to provide a useful coating dispersion, 16 g of the mixture of Example 1 was combined with 140 g of 0.125" diameter steel shot in a 120 ml glass bottle. The bottle was tightly sealed and then milled for 18 h at 300 rpm. The thick meringue-like product was removed from the milling vessel and placed in the Tsukiage cup coater. An attempt to coat the 31 cm long aluminum sleeve at 380 mm/min resulted in a very poor streaky coating on the first 3–4 cm no deposition of material at all on the remaining length of the sleeve.

EQUIVALENTS

Those skilled in the art will recognize, or be able to ascertain using no more than routine experimentation, numerous equivalents to the specific procedures described herein. Such equivalents are considered to be within the scope of the present invention and are covered by the following claims. The contents of all references, issued patents, and published patent applications cited throughout this application are hereby incorporated by reference. The appropriate components, processes, and methods of those patents, applications and other documents may be selected for the present invention and embodiments thereof.

What is claimed is:

1. A method of coating a substrate with a waterbome coating to form a coated donor member, comprising a) combining a resin, a pigment, and water in proportions effective to provide a donor member coating precursor composition;

b) subjecting said donor member coating precursor composition to high pressure communition to provide a donor member conductive coating composition; and c) coating said donor member conductive coating composition onto a substrate.

2. The method of claim 1 wherein said resin is a phenolic resin.

3. The method of claim 2 wherein said phenolic resin is a waterborne phenolic resin.

4. The method of claim 1 wherein said pigment is a conductive pigment.

5. The method of claim 1 wherein said pigment is selected from the group consisting of carbon black, graphite, magnetite, nigrosine, and combinations thereof.

6. The method of claim 1 wherein said coating is substantially free of air pockets or other defects.

7. The method of claim 1 wherein said high pressure communition step is carried out using a high pressure communition device selected from the group consisting of piston homogenizers and two stage homogenizers.

8. A method of preparing a donor member conductive coating, comprising a) combining a resin, a pigment, and water in proportions effective to provide a donor member coating precursor composition; and b) subjecting said donor member coating precursor composition to high pressure communition to provide a donor member conductive coating composition.

9. The method of claim 8 wherein said resin is a phenolic resin.

10. The method of claim 9 wherein said phenolic resin is a waterborne phenolic resin.

11. The method of claim 8 wherein said pigment is a conductive pigment.

12. The method of claim 8 wherein said combination step comprises dispersing said pigment into said donor member conductive coating composition without resulting in substantial foaming or air entrainment.

13. The method of claim 8 wherein said pigment is selected from the group consisting of carbon black, graphite, magnetite, nigrosine, and combinations thereof.

14. An image forming apparatus, comprising:

a) a charge-retentive surface to receive an electrostatic latent image thereon;

b) a donor member to apply a developer material to said charge-retentive surface to develop said electrostatic latent image to form a developed image on said charge retentive surface, said donor member having coated thereupon a waterbome donor member coating composition prepared by a process comprising combining a resin, a pigment, and water in proportions effective to provide a donor member precursor composition; and subjecting said donor member precursor composition to high pressure communition to provide a waterborne donor member coating composition;

c) a transfer component to transfer said developed image from said charge retentive surface to a copy substrate; and d) a fixing component to fuse said transferred developed image to said copy substrate.

15. The apparatus of claim 14, wherein said developer material is a developer comprising toner particles.

16. The apparatus of claim 14 wherein said resin is a phenolic resin.

17. The apparatus of claim 14 wherein said pigment is a conductive pigment.

18. The apparatus of claim 14 wherein said pigment is selected from the group consisting of carbon black, graphite, magnetite, nigrosine, and combinations thereof.

19. The apparatus of claim 14 wherein said coating is substantially free of air pockets or other defects.

20. A coated donor roll having a core with a donor roll coating composition thereupon, said donor roll coating composition prepared by a process comprising combining a resin, a pigment, and water in proportions effective to provide a donor roll coating precursor composition; and subjecting said donor roll coating precursor composition to high pressure communition to provide a donor roll conductive coating composition.

21. The coated donor roll of claim 20 wherein said resin is a phenolic resin.

22. The coated donor roll of claim 20 wherein said pigment is a conductive pigment.

23. The coated donor roll of claim 20 wherein said pigment is selected from the group consisting of carbon black, graphite, magnetite, nigrosine, and combinations thereof.

24. The coated donor roll of claim 20 wherein said coating is of a thickness of from about 3 to about to 50$\mu$.

25. The coated donor roll of claim 20 wherein said coating is substantially free of air pockets or other defects.

26. An image forming apparatus for forming images on a recording medium comprising:

a) a charge-retentive surface to receive an electrostatic latent image thereon; and b) a donor roll having a core with a donor roll conductive coating composition thereupon, to apply a developer material to said charge-retentive surface to develop said electrostatic latent image to form a developed image on said charge retentive surface, said donor roll conductive coating composition prepared by a process comprising combining a resin, a conductive pigment, and water in proportions effective to provide a donor roll conductive coating precursor composition; and subjecting said donor roll conductive coating precursor composition to high pressure communition to provide said donor roll conductive coating composition; and c) a transfuse component to transfer said developed image from said charge retentive surface to said recording medium and to fuse said developed image to said recording medium.

27. The apparatus of claim 26, wherein said developer material is a developer comprising toner particles.

28. The apparatus of claim 26, wherein said resin is a phenolic resin.

29. The apparatus of claim 28, wherein said phenolic resin is a waterborne phenolic resin.

30. The apparatus of claim 26, wherein said conductive pigment is selected from the group consisting of carbon black, graphite, magnetite, nigrosine, and combinations thereof.

31. The apparatus of claim 26, wherein said coating is of a thickness of from about 3 to about to 50$\mu$.

32. The apparatus of claim 26, wherein said coating is substantially free of air pockets or other defects.

* * * * *